US005297737A

United States Patent [19]

Davisson

[11] Patent Number: 5,297,737

[45] Date of Patent: Mar. 29, 1994

[54] SPRINKLER FROST CLIP

[75] Inventor: Paul D. Davisson, Walla Walla, Wash.

[73] Assignee: Nelson Irrigation Corporation, Walla Walla, Wash.

[21] Appl. No.: 40,033

[22] Filed: Mar. 30, 1993

[51] Int. Cl.[5] ..... B05B 3/04

[52] U.S. Cl. ..... 239/222.17; 239/500; 239/516; 403/373

[58] Field of Search ..... 239/214, 222.11, 222.17, 239/222.19, 222.21, 500, 505, 516, 104, 106, 112, 113; 24/543, 487; 403/373, 374

[56] References Cited

U.S. PATENT DOCUMENTS

| | | | |
|---|---|---|---|
| 1,228,658 | 6/1917 | Gaines | 239/505 |
| 1,723,180 | 8/1929 | Kerr | 239/505 |
| 1,751,345 | 3/1930 | Matsui . | |
| 2,488,234 | 11/1949 | Perry | 239/500 |
| 3,106,347 | 10/1963 | Hayes | 239/505 |
| 4,121,769 | 10/1978 | Drori | 239/222.17 |
| 4,461,423 | 7/1984 | Davis | 239/231 |
| 4,625,915 | 12/1986 | Cockman | 239/390 |
| 4,660,765 | 4/1987 | Rosenberg | 239/222.17 |
| 4,660,766 | 4/1987 | Nelson et al. | 239/222.17 |
| 4,783,005 | 11/1988 | Rosenberg | 239/222.17 |
| 4,817,869 | 4/1989 | Rubinstein | 239/222.17 |
| 4,832,264 | 5/1989 | Rosenberg | 239/222.17 |

*Primary Examiner*—Karen B. Merritt
*Attorney, Agent, or Firm*—Nixon & Vanderhye

[57] ABSTRACT

A frost clip is provided for a rotary sprinkler of the type which includes a sprinkler body, a nozzle for emitting a stream and a rotatable distributor plate adapted to receive and redirect the stream. The frost clip is attachable to the sprinkler body so as to be intermittently engaged by the stream as the distributor plate rotates about its axis of rotation. The frost clip is formed with a channel facing radially towards and extending substantially parallel to an axis of rotation of the rotor plate. The channel is constructed and arranged to intermittently deflect the stream back toward the rotor plate and at least a portion of the sprinkler body as the stream rotates past the clip, to thereby inhibit ice buildup on the rotor plate and adjacent sprinkler body portions.

15 Claims, 2 Drawing Sheets

Fig. 3
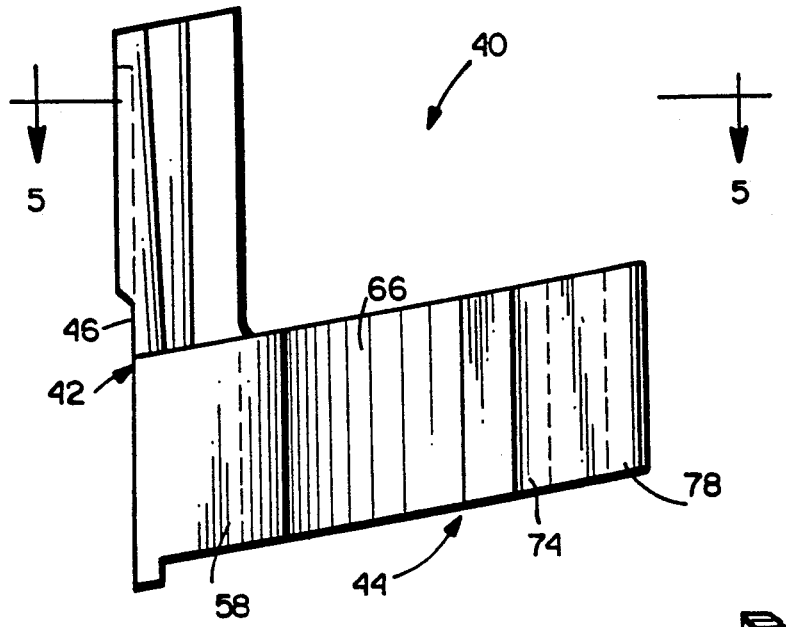
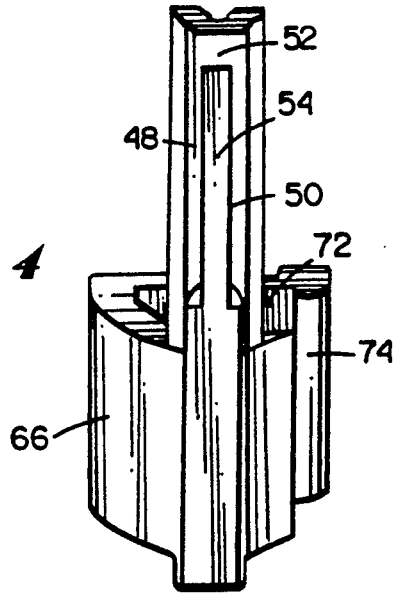
Fig. 4
Fig. 5
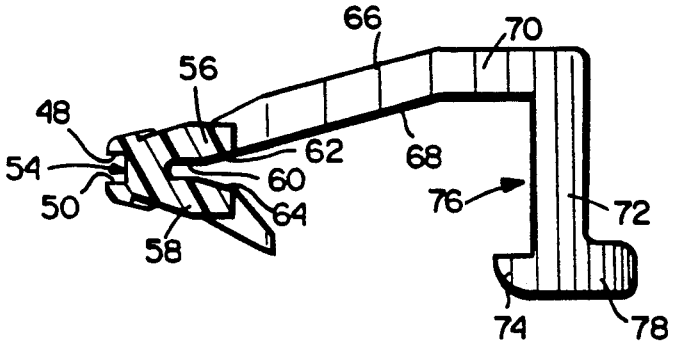

SPRINKLER FROST CLIP

This invention relates to sprinklers, typically of the rotary type, and to a removable frost clip designed to deflect a portion of the rotating sprinkler stream back onto portions of the sprinkler in order to discourage ice build up.

BACKGROUND AND SUMMARY OF THE INVENTION

Providing frost protection for fruit and nut trees; is a common but necessary occurrence, usually in early spring. Freezing of buds, flowers, or fruit can be detrimental to the crop, but fortunately, there are several ways to help protect against frost damage.

Generally, all frost/cold protection methods consist of one or more of the following principles according to the Washington State University Irrigated Agricultural Research and Extension Center:

(1) good site selection for adequate air drainage;

(2) mixing of air (for example, wind machines or helicopters);

(3) direction convention heating of the air (heaters or under-tree sprinklers);

(4) radiant heating directly to the plant (for example, heaters or under-tree sprinklers);

(5) release of the latent heat of fusion (for example, freezing water directly on the plant via over-tree sprinklers);

(6) release of the latent heat of condensation (for example, humidification, fogs or sprinklers);

(7) radiative heat loss interception (for example, fog or cover);

(8) utilization or soil heat storage (for example, bare soils);

(9) thermal insulation (for example, covering foams or greenhouses);

(10) bloom delay (for example, over-tree sprinklers and/or tree wraps and paint);

(11) planting cold hearty and/or late blooming varieties; and

(12) genetic development of cold resistant plants.

Insofar as sprinklers are a common link to many of the above described modes of protection, it is critical to prevent ice formation on the sprinkler itself which would otherwise render the sprinkler useless as a frost protection device. All sprinklers inevitably freeze up at some point in varying weather conditions and are unable to function properly. Accordingly, the present invention relates to a removable clip that is attachable to a variety of rotating type sprinklers that will enable the sprinkler to function in severe weather conditions. When the clip in accordance with this invention is installed on the sprinkler body, a small burst of water is deflected off the clip and onto the top of the rotating stream distributor plate as well as onto other adjacent parts of the sprinkler body. The deflected water helps warm the rotating plate and the sprinkler body and keeps water flowing across these parts, thereby discouraging ice build up. The clip is constructed so that it can be easily attached and removed, but it will be appreciated that the clip could also be made integral with the sprinkler body itself, or with the sprinkler rotating distributor plate.

In an exemplary embodiment of the invention, a clip is described for use with a rotating sprinkler manufactured by the assignee, Nelson Irrigation Corporation, and known as the R-10 "mini" rotator. The sprinkler includes a sprinkler body mounting a nozzle for emitting a single vertical stream upwardly into a contoured groove within a rotatable distributor plate which is supported by the sprinkler body directly above and in axial alignment with the nozzle axis. The stream emitted from the nozzle causes the rotator plate to rotate about its own axis (the speed of rotation is controlled by a viscous brake also mounted within the sprinkler body) and the groove in the rotator plate is configured to redirect the stream substantially horizontally radially outwardly from the sprinkler body. The controlled rate of rotation of the rotator plate results in a substantially single stream rotating relatively slowly about the axis of the rotator plate. The frost clip in accordance with this invention is mounted to a sprinkler body arm which is otherwise directly in the path of the rotating stream. The sprinkler body arm is typically tapered to a point to split the stream without creating a "blind spot" but, in this instance, the frost clip deflects a portion of the stream back onto the rotor plate and adjacent the sprinkler body portions.

In the exemplary embodiment, the clip includes a relatively flexible horizontal portion adapted to clip onto the vertical portion of one of the sprinkler body arms, and also includes a vertical portion having an integral groove which faces radially towards the axis of rotation of the rotator. As the rotator plate rotates, the single stream will impinge upon the frost clip groove and direct the water back on top of the rotor plate and adjacent sprinkler body portions.

Thus, in accordance with the broader aspects of the invention, there is provided in a rotary sprinkler having a nozzle for emitting a primary stream along a center axis of the nozzle and a rotary distributor plate spaced from the nozzle for redirecting the stream to achieve a desired sprinkling pattern, the improvement comprising means for intermittently deflecting at least a portion of the stream redirected by the distributor plate back onto the distributor plate.

It will be apparent that the frost clip in accordance with this invention helps keep ice from building up on the plate, allowing it to run at lower temperatures than are possible without the clip. Moreover, the back splash feature has only a minimal effect on the distribution pattern of the sprinkler. Other objects and advantages will become apparent from the detailed description which follows.

BRIEF DESCRIPTION OF THE DRAWINGS

FIG. 3 is a side view of the frost clip in accordance with this invention;

FIG. 4 is a front end view of the clip illustrated in FIG. 3; and

FIG. 5 is a plan view, partially in section, of the frost clip shown in FIG. 3.

DETAILED DESCRIPTION OF THE DRAWINGS

Figure 1:
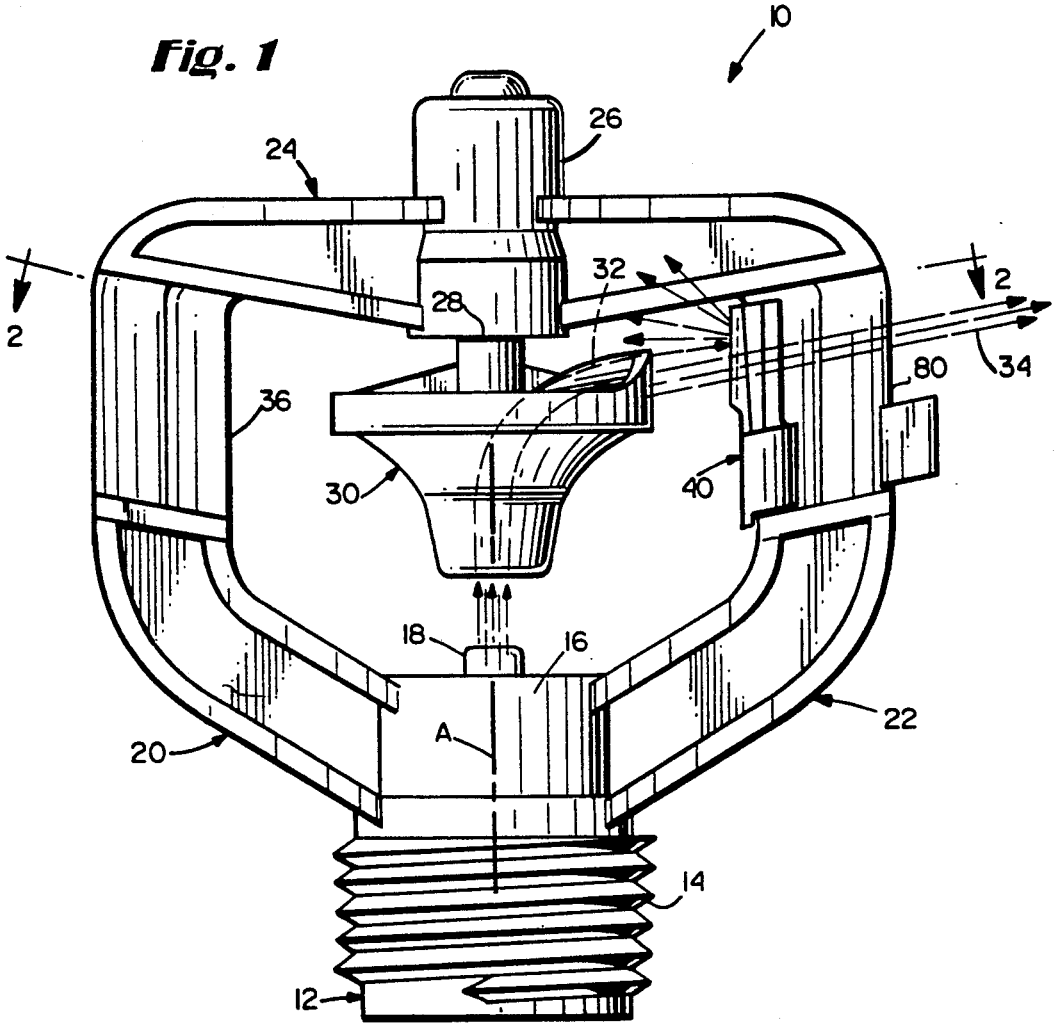
FIG. 1 is a side view of a rotating sprinkler incorporating the frost clip in accordance with this invention.

Referring now to FIG. 1, a rotary sprinkler head 10 includes an inlet portion 12 provided with external threads 14 adapted for connection to a source of water under pressure. A tubular portion 16 mounts a removable nozzle 18 having a center axis A extending vertically through the sprinkler head. The nozzle 18 emits a substantially solid stream vertically upwardly into the atmosphere.

The sprinkler body also includes a pair of arms 20, 22 extending outwardly and upwardly from the tubular portion 16 axially adjacent the inlet portion 12, in diametrically opposed relationship. An integral cross brace 24 extends laterally between the upper ends of arms 20, 22 and supports a rotor "motor" 26 in alignment with, and vertically spaced from the nozzle 18. The rotor "motor" 26 includes an internal viscous brake (not shown) of the type disclosed in commonly owned U.S. Pat. No. 4,660,766. A rotatable shaft 28 extends downwardly, out of the rotor motor 26, and mounts a rotary distributor plate 30 for rotation with the shaft. It will be appreciated that the shaft 28 defines the rotational axis of the plate 30, and shaft 28 is also coincident with the center axis A of the nozzle 18. The distributor plate 30 is formed on its lower side with an internal groove or channel 32 which, at its lowermost end, is aligned with the center axis of the nozzle 18, and is centered within the plate so as to receive the single stream emitted from the nozzle. The groove 32 redirects the stream to a generally horizontal direction as shown at 34. in FIG. 1. The groove or channel 32 is also formed with a slight curve about the axis of rotation as defined by shaft 28 so that impingement of the stream on the rotor plate 30 causes the latter to rotate. The speed of rotation is controlled by the viscous brake in the manner described in the aforementioned '766 patent.

It will be appreciated that under normal circumstances, as the rotary distributor plate 30 rotates with the shaft 28, the single stream will intermittently strike the vertical portions of the sprinkler body arms 20 and 22. These arms are formed with knife edges 36, 38 which face radially inwardly, so that the stream is cleanly split as it rotates past the knife edges. To this point, the sprinkler head as described above is a conventional R-10 model rotator made and sold by the assignee of this invention.

Figure 2:
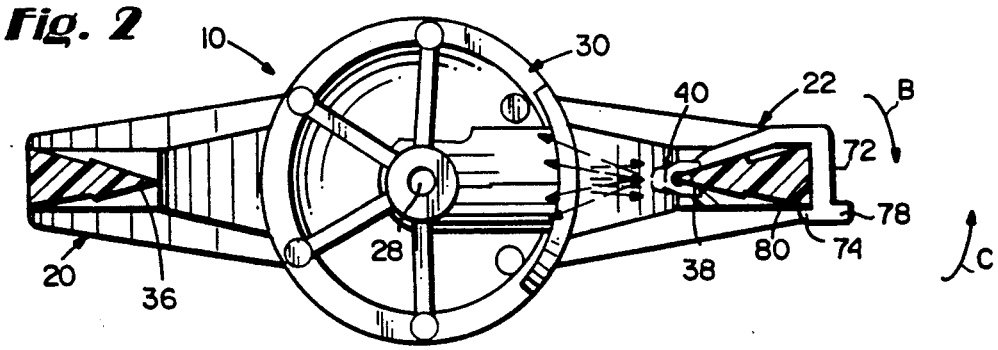
FIG. 2 is a section in plan along the line 2—2 of FIG. 1.

In accordance with the present invention, a frost clip 40 may be snapped into place on one of the arms 20, 22, and specifically along one of the knife edges 36 or 38 (shown along knife edge 38 in FIGS. 1 and 2).

The following description of the frost clip 40 is provided with reference to the sprinkler in an upright position as shown in FIG. 1. Accordingly, descriptive terms such as vertical, horizontal, front, back, and the like are for explanation purposes only, it being understood that, in use, the sprinkler may assume other orientations. With reference now particularly to FIGS. 3–5, the clip 40 generally may be considered as having a substantially upright stream deflecting portion 42, and a generally horizontal mounting portion 44. As viewed in FIG. 3, the clip 40 thus is seen to have a generally L-shape.

The stream deflecting portion 42 has a substantially vertical front face 46. The upper half of the front face is bordered by projecting side walls 48, 50 and a top wall 52, thereby creating a stream deflecting groove or channel 54. The back face of the stream deflecting portion is formed with a generally C-shape when viewed in plan (FIG. 5), with rearwardly extending legs 56, 58 defining an open, rearwardly facing groove 60. The rearwardmost inner surfaces of legs 56, 58 are tapered outwardly at 62, 64, for reasons given below.

The mounting portion 44 includes a rearwardly extending arm 66 which, in plan, has an inner tapered surface 68 which flows smoothly into the tapered surface 62. At the rearward end of the tapered surface 68, the mounting arm is formed with a straight portion 70, transverse leg 72 and a return leg 74, such that a squared-off recess 76 is formed by the portion 70, transverse leg 72 and return leg 74. Finally, the mounting arm includes a tab 78 extending outwardly from the transverse leg 72, opposite the return leg 74. The tab 78 facilitates attachment and -removal of the clip 40 from the sprinkler head 10 as described further below.

With reference again to FIG. 2, it can be seen that the knife edge 38 is receivable within the groove 60, with tapered surfaces of the arm 22 which form the knife edge 38 engaged by the mating tapered surfaces 62, 68 of the clip 40. At the same time, the rear face 80 of the arm (FIGS. 1, 2) is receivable within the squared-off recess 76. To attach the clip, the knife edge 38 is first located within the clip groove 60, and the mounting portion 44 is then snapped into place over the rear face 80 of the arm 22 in the direction of arrow B. To remove the clip, pressure may be applied to the tab 78 in the direction of arrow C, and the flexible properties of the clip will permit the return leg 74 to be disengaged from the arm.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a rotary sprinkler having a body portion mounting a nozzle for emitting a substantially solid stream along a center axis of the nozzle and a rotary distributor plate spaced form said nozzle for redirecting the stream to achieve a desired sprinkling pattern, said sprinkler body portion including a pair of arms extending upwardly on opposite sides of said nozzle and wherein said rotary distributor plate is supported above said nozzle by said pair of arms, the improvement comprising a deflector for intermittently deflecting at least a portion of the substantially solid stream redirected by said distributor plate back onto said distributor plate, said deflector attached to one of said pair of arms, and having a channel extending substantially parallel to said center axis and facing the distributor plate so as to intermittently engage said substantially solid stream during rotation of the rotary distributor plate.

2. The rotary sprinkler of claim 1 wherein said deflector is formed with a mounting portion which partially surrounds said one of said pair of arms.

3. The rotary sprinkler of claim 1 wherein said rotary distributor plate is formed with an emitter channel which redirects the stream from a substantially vertical orientation to a substantially horizontal orientation.

4. The rotary sprinkler of claim 1 wherein said distributor plate is mounted for rotation about an axis coincident with said center axis of said nozzle.

5. In a rotary sprinkler comprising a sprinkler body, a nozzle for emitting a substantially solid stream along a center axis of the nozzle and a rotatable distributor plate adapted to receive and redirect said substantially solid stream, the improvement comprising a frost clip attachable to said sprinkler body so as to be intermittently engaged by said substantially solid stream distributor plate rotates said frost clip having a channel facing radially toward and extending substantially parallel to an axis of rotation of said distributor plate, said channel constructed and arranged to deflect said substantially solid stream back toward the distributor plate and at least a portion of said sprinkler body to thereby inhibit ice buildup on said distributor plate and adjacent sprinkler body portions.

6. The rotary sprinkler of claim 5 wherein said sprinkler body includes a pair of arms extending upwardly on opposite sides of said nozzle and wherein said distributor plate is supported above said nozzle for rotation about an axis coincident with said center axis, by said pair of arms.

7. The rotary sprinkler of claim 6 wherein said frost clip is formed with a mounting portion partially surrounding said one of said pair of arms.

8. The rotary sprinkler of claim 5 wherein said clip is constructed of plastic.

9. The rotary sprinkler of claim 5 wherein said clip is formed with a mounting portion extending substantially perpendicularly away from said channel.

10. A rotary sprinkler head comprising:

a sprinkler body having an outlet defined by a nozzle having a center axis, said nozzle adapted to emit water under pressure in a substantially solid stream along said center axis; a rotary distributor plate mounted for rotational movement about an axis coincident with said center axis of said nozzle, said rotary distributor plate having a channel formed therein, an inlet portion of said channel in alignment with said center axis and outlet portion inclined to said center axis to thereby redirect the stream; and a frost clip removably attached to said sprinkler body at a location where said clip will be intermittently engaged by the substantially solid stream leaving said rotary distributor plate as said rotary distributor plate rotates past said clip, said clip having a channel extending substantially parallel to said center axis for deflecting at least a portion of said substantially solid stream onto at least an upper portion of said rotary distributor plate.

11. A frost clip for attachment to a rotary sprinkler having a sprinkler body having an outlet defined by a nozzle having a center axis, said nozzle adapted to emit water under pressure in a primary stream along said center axis; and a rotary distributor plate mounted for rotational movement about an axis coincident with said center axis of said nozzle, said rotary distributor plate having a channel formed therein, an inlet portion of said channel in alignment with said center axis and an outlet portion inclined to said center axis to thereby redirect the primary stream, the frost clip comprising a stream deflecting portion and a mounting portion extending substantially perpendicularly from each other; said deflecting portion having a substantially vertical channel facing in a first direction, and a substantially vertical sprinkler arm receiving groove facing in a second direction substantially opposite said first direction.

12. The frost clip of claim 11 wherein said clip is constructed of plastic.

13. The frost clip of claim 11 wherein said mounting portion extends substantially horizontally away from a lower end of said stream deflecting portion.

14. The frost clip of claim 13 wherein said mounting portion includes a pair of parallel surfaces connected by a transverse surface.

15. The frost clip of claim 14 wherein a tab is provided which extends outwardly from said transverse surface, away from said stream deflecting portion.

* * * * *